US009376877B2

(12) United States Patent
Yue et al.

(10) Patent No.: US 9,376,877 B2
(45) Date of Patent: Jun. 28, 2016

(54) SYSTEM AND METHOD FOR SETTING A COMPLETION TOOL

(71) Applicant: CNPC USA Corp., Houston, TX (US)

(72) Inventors: Jianpeng Yue, Sugar Land, TX (US); Xin Sun, Karamay (CN); Xinke Yang, Karamay (CN); Perry M. Batson, Jr., Houston, TX (US); Peng Cheng, Sugar Land, TX (US); Kuo-Chiang Chen, Sugar Land, TX (US)

(73) Assignee: CNPC USA Corp., Houston, TX (US)

( * ) Notice: Subject to any disclaimer, the term of this patent is extended or adjusted under 35 U.S.C. 154(b) by 138 days.

(21) Appl. No.: 14/262,384

(22) Filed: Apr. 25, 2014

(65) Prior Publication Data

US 2015/0308206 A1 Oct. 29, 2015

(51) Int. Cl.

| | |
|---|---|
| ***E21B 23/01*** | (2006.01) |
| ***E21B 23/06*** | (2006.01) |
| ***E21B 33/128*** | (2006.01) |

(52) U.S. Cl.

CPC ..... *E21B 23/01* (2013.01); *E21B 23/06* (2013.01); *E21B 33/1285* (2013.01)

(58) Field of Classification Search

CPC ..... E21B 23/01; E21B 23/06; E21B 33/1285
See application file for complete search history.

(56) References Cited

U.S. PATENT DOCUMENTS

| | | | | |
|---|---|---|---|---|
| 2,715,441 | A * | 8/1955 | Bouvier | E21B 33/1294 166/127 |
| 3,049,177 | A | 8/1962 | Bonner | |
| 3,374,841 | A | 3/1968 | Current | |
| 4,180,132 | A * | 12/1979 | Young | E21B 23/006 166/120 |
| 4,311,194 | A * | 1/1982 | White | E21B 23/04 166/120 |
| 5,377,749 | A * | 1/1995 | Barbee | E21B 23/06 166/120 |
| 5,404,955 | A * | 4/1995 | Echols, III | E21B 23/06 166/122 |
| 6,241,023 | B1 | 6/2001 | Krauss et al. | |
| 7,143,832 | B2 | 12/2006 | Freyer | |
| 7,387,158 | B2 | 6/2008 | Murray et al. | |
| 8,534,368 | B2 * | 9/2013 | Reimert | E21B 23/01 166/208 |

FOREIGN PATENT DOCUMENTS

| | | |
|---|---|---|
| CA | 2226238 C | 6/2006 |

* cited by examiner

*Primary Examiner* — Shane Bomar
(74) *Attorney, Agent, or Firm* — Andrew W. Chu; Craft Chu PLLC

(57) ABSTRACT

The system and method for setting a completion tool within a wellbore includes assembling a mandrel, inner sleeve, piston, outer sleeve, and dog member. In a first locked position, the dog member abuts against the indentation of the mandrel and the locking surface of the piston. The dog member is friction fit between the piston and mandrel so that movement of the completion tool corresponds to movement of the mandrel. The mechanical link, such as shear pins, of the completion tool is protected by the dog member holding steady on the mandrel. When the completion tool reaches the desired location, a pressure pulse opens a chamber between the sleeves to transition to a second released position. The dog member releases from the mandrel to be housed in the chamber, when movement of the mandrel sets the completion tool by the mechanical link, such as shear pins.

20 Claims, 5 Drawing Sheets

SYSTEM AND METHOD FOR SETTING A COMPLETION TOOL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to well completion for the production of fluids within a wellbore. More particularly, the present invention relates to completion tools, such as packers, liner hangers, and anchors. Even more particularly, the present invention relates to control of setting completion tools in the wellbore.

2. Description of Related Art Including Information Disclosed Under 37 CFR 1.97 and 37 CFR 1.98

Land formations producing oil and gas have different zones. There are zones producing different mixtures of oil and gas. There are zones producing other fluids, such as water. There are zones producing no fluids at all. A wellbore or casing or both can pass through any number and combination of these zones. Isolating the productive zones, containing the desired range of oil and gas, is a feature of well completion. The well is completed so as to begin production of hydrocarbons from the well.

One example is the open-hole completion for producing oil and gas in a wellbore. In open-hole wells, standard casing is cemented only into upper portions of the well, and not through the producing zones further along the wellbore. For a well completion, a liner is run from the bottom of the casing portion of the well and down through the various zones in the wellbore. In a typical production of oil and gas in a wellbore, production tubulars or production casings are inserted in the wellbore as the liner system. One completion tool is a liner hanger or anchor, which is set in the casing portion to fasten the liner system to the casing portion.

The liner system fills the interior of the wellbore past the casing portion and supports the walls of the wellbore. Liners minimize the annular space between the production tubulars and the wellbore wall for mechanical support and restriction of annular flow of fluids around the production tubulars of the liner. Due to irregularities in an un-cased wellbore wall, liners cannot prevent annular flow in the wellbore. For this reason, a liner system uses another completion tool, called a packer. A packer stops annular flow of fluids around the production tubulars. Packers isolate various zones within the wellbore and along the liner by forming annular seals, or barriers, between the liner and the wellbore wall. Fluid can no longer flow around the liner system across zones.

Open-hole well completions are particularly useful in slant-hole wells, wherein the wellbore can deviate and run horizontally for thousands of feet through a producing zone. Packers are annular isolators placed along the length of the horizontal production tubing to allow selective production from a particularly productive zone or isolation of a non-productive zone.

Completion tools must be set at the proper depth and along the proper length of the production tubular of the liner system. Various patents have been issued relating to setting packers and other completion tools in liner systems.

The conventional structure to lock the completion tool is the shear pin. The shear pins are torn, when the tool, such as the packer, is deployed to the proper location. Mechanical action shears the pin so that the expandable element of the packer can activate. Once the shear pin is ruptured, the slip devices can be expanded to affix to the wellbore or casing. U.S. Pat. No. 3,049,177, issued to Bonner on Aug. 14, 1962 shows the well known conventional shear pin. The packer is delivered to the desired location, and a mechanical severing of the shear pin sets the packer in place. U.S. Pat. No. 3,374,841, issued to Current on Mar. 26, 1968, discloses a packer set by severing shearing members. The number of shearing members varies, so that the amount of force needed to break the shearing members can be controlled. A tool with a higher number of shearing members requires more force to sever and set, so that this tool can be placed differently than a tool with a lower number of shearing members.

Another conventional structure to lock the completion tool is a chemical agent. When the completion tool reaches the desired location, a chemical reagent is introduced at the tool to trigger the expandable element to activate. Once the chemical reagent is exposed to the expandable element, the completion tool is affixed to the wellbore or casing. Alternatively, chemical shear pins can be dissolved in reaction to exposure to a chemical reagent introduced into the wellbore.

U.S. Pat. No. 7,387,158, issued on Jun. 17, 2008 to Murray et al., discloses a packer that has a main sealing element that swells after a delay that is long enough to get the sealing element into a proper position. A sleeve is removed from the packer so as to allow well fluids to contact the main sealing element so as to start the swelling process. The main sealing element swells until the surrounding tubular or the surrounding wellbore is sealed.

U.S. Pat. No. 7,143,832, issued on Dec. 5, 2006 to Fyer, discloses an annular packer arranged on the outside of the production tubing. The packer has a core that has an elastic polymer that swells by the addition of hydrocarbons. The core can be surrounded by an external mantel of rubber. The external mantel of rubber is permeable to hydrocarbons and may be equipped with a reinforcement. The core swells by absorption of hydrocarbons and the packer expands accordingly. The expansion of the packer seals the annular space between the production tubing and the well wall.

There are other known systems with means to protect the setting shear pins of completion tools, such as packer, liner hangers, and anchors.

U.S. Pat. No. 6,241,023, issued to Krauss et al on Jun. 5, 2001, teaches another system and method for setting a packer using dogs and shear pins. The dogs are set on the mandrel in a set position relative to the packer. At the intended packer location, the mandrel is pulled up to sever a first shear pin, which releases the dogs. The dogs engage the packer and mechanical set the packer with sufficient force according to a second shear pin. Once the severing of the second shear pin signifies that the packer has been set. The breakage of the first shear pin controls when the dogs are released for the breakage of the second shear pin.

It is an object of the present invention to provide an embodiment of a system for setting a completion tool to protect the shear pins for setting the completion tool during run-in.

It is an object of the present invention to provide an embodiment of a system for setting a completion tool to protect the shear pins for setting the completion tool from accidentally setting before reaching the desired location in the wellbore.

It is an object of the present invention to provide an embodiment of a system for setting a completion tool to prevent damage and wear on the mechanical link or shear pins for setting the completion tool.

It is another object of the present invention to provide an embodiment of a system for setting a completion tool with the mandrel locked to the completion tool until the completion tool is ready to be set.

It is still another object of the present invention to provide an embodiment of a system for setting a completion tool with the mandrel locked by dogs during run-in.

It is still another object of the present invention to provide an embodiment of a system for setting a completion tool with the mandrel releasing the dogs, when the completion tool is ready to be set.

It is yet another object of the present invention to provide an embodiment of a system for setting a completion tool with the mandrel releasing the dogs by a pressure pulse, when the completion tool is ready to be set.

It is still another object of the present invention to provide an embodiment of a system for setting a completion tool with the mandrel locked by dogs during run-in to withstand greater force than the mechanical link or shear pins for setting the completion tool.

It is yet another object of the present invention to provide an embodiment of a system for setting a completion tool with the mandrel engaging the completion tool with a connection stronger than a connection between the mechanical link or shear pins for setting the completion tool.

It is yet another object of the present invention to provide an embodiment of a system for setting a completion tool with the mandrel engaging the completion tool by a dog resistant to severing.

It is yet another object of the present invention to provide an embodiment of a system for setting a completion tool with the mandrel mechanically engaging the completion tool, until the completion tool is ready to be set.

These and other objectives and advantages of the present invention will become apparent from a reading of the attached specification.

SUMMARY OF THE INVENTION

Embodiments of the system for setting a completion tool within a wellbore include a mandrel, an inner sleeve of the completion tool, a piston of the completion tool, an outer sleeve of the completion tool, and a dog means. A completion tool can be a packer, a liner hanger, or an anchor or other tool set by a severing a mechanical link. The completion tool is set by shear pins or other mechanical link, which a severed when the completion tool reaches the desired location within the wellbore. The system of the present invention prevents the shear pins or other mechanical link from severing at the wrong time and wrong place within the wellbore. Additionally, the system of the present invention protects wear on the shear pins or other mechanical link during the run in through the wellbore. When run in, movement of the mandrel back and forth stresses the shear pins or other mechanical link, during conventional installation. The embodiments of the present invention protect the shear pins or other mechanical link from these exposures to damage and wear. There is more consistent and reliable setting of the completion tool by a mechanical link, such as shear pins, when the completion tool is intended to be set.

In one embodiment, the mandrel has a generally tubular shape and is comprised of an indentation on an exterior and a pressure inlet through a side wall of the mandrel. The indentation or indentations can be set in a ring around the tubular mandrel. Each indentation is a concavity having sliding surfaces at opposite ends. The sliding surfaces extend from a bottom of the indentation to the exterior. The inner sleeve fits over the mandrel. The inner sleeve is also generally tubular. There is an interior surface facing the mandrel and an exterior surface facing outward. The interior surface is comprised of an aperture through a side wall of the inner sleeve and a pressure conduit through the side wall of the inner sleeve. The pressure conduit can be aligned with the pressure inlet for fluid connection between the mandrel and the inner sleeve.

The piston mounts on the inner sleeve and faces the exterior surface of the inner sleeve. The piston can be tubular or other cam element compatible along the common axis of the mandrel and inner sleeve. In embodiments of the present invention, the piston has a locking surface at one end. The locking surface faces the exterior surface of the inner sleeve. An outer sleeve covers the piston. The outer sleeve is also generally tubular with an interior side wall facing the piston and an exterior sidewall facing outward. The interior side wall and exterior surface of the inner sleeve form a gap between the outer sleeve and the inner sleeve. The piston housed within the gap and can slide longitudinally along the interior side wall of the outer sleeve and the exterior surface of the inner sleeve.

Embodiments of the present invention include the dog means with a mandrel interface, piston interface on an end opposite the mandrel interface, a first face, and a second face on a side opposite the first face. The dog means is the mechanical connection between the mandrel and the completion tool, which removeably engages the mandrel, the inner sleeve, and the piston. The mechanical connection of the dog means is stronger and more resilient than any shear pin of the completion tool, so the dog means bears the most stress, during back and forth movement of the mandrel.

For run in, the system is in a first locked position. The dog means is locked in place relative to the completion tool and mandrel. The mandrel interface abuts against the indentation of the mandrel, and the piston interface abuts against the locking surface of the piston. Being sandwiched, the dog means is friction fit between the locking surface of the piston and the indentation of the mandrel. For setting the completion tool, the system is in a second released position. The outer sleeve, the inner sleeve and the one end of the piston form a chamber within the gap. The dog means releases from the indentation to be housed within the chamber. Movement of the mandrel to set the completion tool separates the dog means from the mandrel so that the shear pins are no longer protected. The completion tool can be set by the shear pins in the conventional manner.

In an embodiment of the present invention, the dog means is a block member with first face and second faces interacting with the inner sleeve. The first face and the second face, generally orthogonal to the mandrel interface engage a first abutment surface and a second abutment surface of the aperture. The middle portion of the first face is adjacent the first abutment surface, and the middle portion of the second face is adjacent the second abutment surface for additional protection of the shear pins or other mechanical link. The dog means as a block member holds steady by the inner sleeve in addition to the piston and mandrel in the first locked position. Further embodiments have the piston with notch, so that a side shoulder of the notch of the piston engages the second surface of the dog means for even more support to protect the shear pins.

In alternate embodiments, the dog means comprises a collet member with a protrusion interacting with the mandrel for engagement to the indentation on the mandrel. The dog means as a collet member holds steady by the protrusion on the indentation, in addition to the piston and the mandrel in the first locked position. In this embodiment, the aperture is comprised of a slot or a slit with an opened end, so that the collet member extends through the aperture to contact the piston. Further embodiments also have the piston with notch, so that a side shoulder of the notch of the piston engages the second surface of the dog means for the added support to protect the shear pins.

Embodiments of the present invention include the method for setting a completion tool within a wellbore. The method includes the steps of: assembling the dog means in a first locked position for run in of the completion tool, positioning the completion tool in a desired location in the wellbore, sending a pressure pulse through the pressure inlet of the mandrel, actuating the piston to move relative to the dog means so as to form the chamber, driving the dog means along a sliding surface of the indentation, releasing the mandrel interface from the indentation of the mandrel, and housing the dog means in the chamber in a second released position for setting the completion tool by shear pins.

In the first locked position, the mandrel interface abuts against the indentation of the mandrel, and piston interface abuts against the locking surface of the piston. The dog means is friction fit between the mandrel and the piston for mechanically engaging and locking the mandrel relative to the completion tool. The pressure pulse enters into the gap between the inner sleeve and the outer sleeve through the pressure inlet and pressure conduit. Moving the mandrel along common axis with the inner sleeve and the outer sleeve dislodges the dog means from the indentation by sliding the dog means along the sliding surface. With the different embodiments of the dog means, the assembly of the dog means in the first locked position includes engaging the block member to the inner sleeve or extending the collet member through the inner sleeve. With different embodiments of the aperture, the assembly of the dog means in the first locked position includes engaging abutment surfaces to the dog means. With different embodiments of the piston, the piston with a notch must also engage the dog means in the first locked position.

DETAILED DESCRIPTION OF THE DRAWINGS

Figure 1:
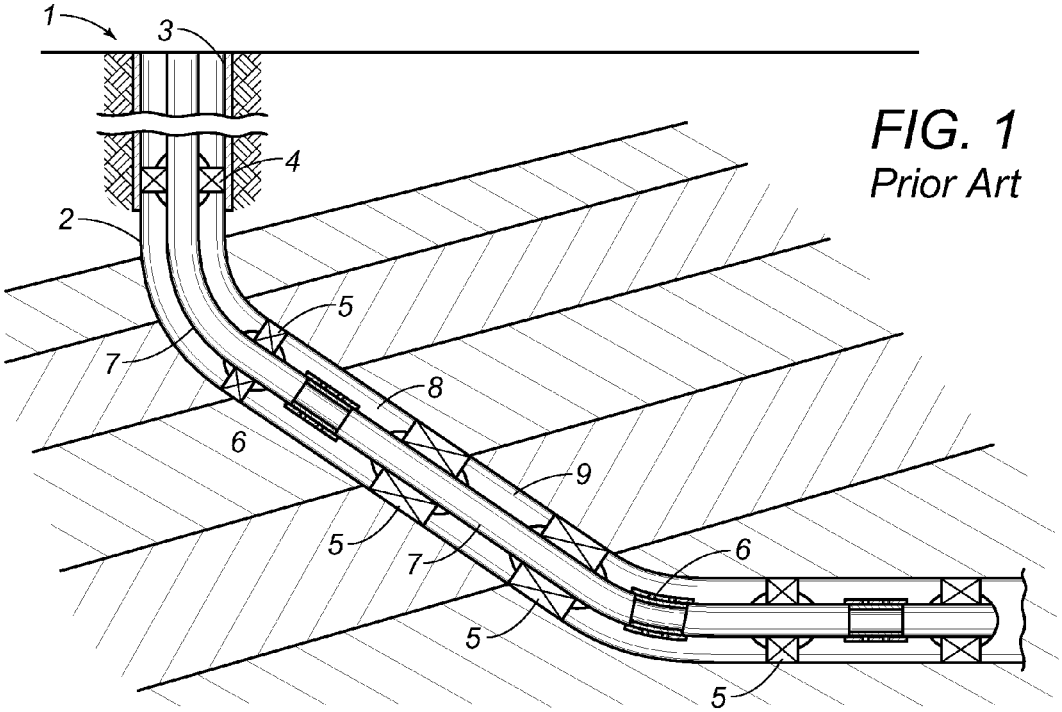
FIG. 1 Prior Art
FIG. 1 is a schematic view of a conventional prior art open hole completion for producing from a wellbore.

FIG. 1 shows conventional open hole completion 1 for producing oil and gas from different zones in a land formation. The completion 1 has a wellbore 2 drilled into the ground. There is a casing 3 at the top end of the wellbore 2. The liner system 7 extends from the casing 3 into the annulus of the wellbore 2. A liner hanger 4 or anchor is set in the casing 3 to support the attachment of the liner system 7 to the casing 3. The liner hanger 4 or anchor is a completion tool in the present application. FIG. 1 also shows a packer 5 set along the wellbore, sealing different zones 8, 9 in the land formation. The packers 5 isolate the zones 8, 9 so that a non-productive zone 9 can be separated from a producing zone 8. The annulus of the wellbore 2 in zone 9 is removed from fluid connection. Sleeves 6 on the liner system 7 can be opened or closed for collecting within the isolated zone 8. The packer 5 is another completion tool in the present application. A packer 5 seals against the annulus and liner system 7 in a desired position to make the correct isolation of the zone. Premature setting of a packer 5 disrupts the completion 1 so that the zones are not properly isolated. Removing and rearranging packers 5 and sleeves 6 on the liner system 7 can be expensive for additional costs and for additional time.

A completion tool of the present invention can be a packer, a liner hanger, an anchor or other known tool set in a wellbore by a mechanical link, such as shear pins. The shear pin or other mechanical link is severed when the completion tool reaches the desired location within the wellbore. The system of the present invention prevents the shear pins or other mechanical link from severing at the wrong time and wrong place within the wellbore.

Figure 2:
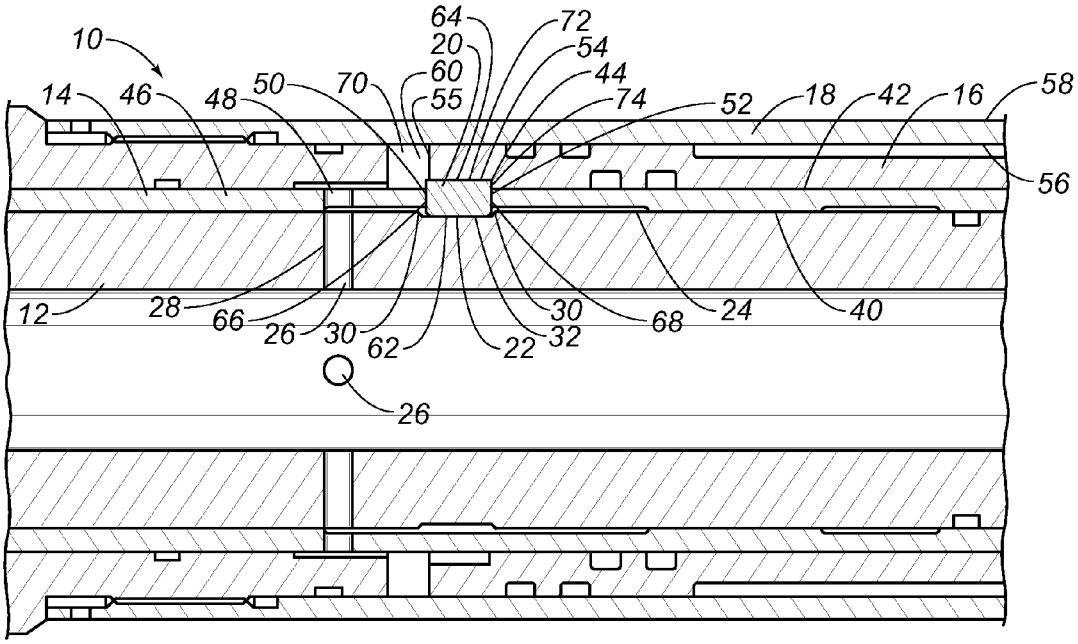
FIG. 2 is a sectional view of an embodiment of the system of the present invention, showing a first locked position.
Figure 3:
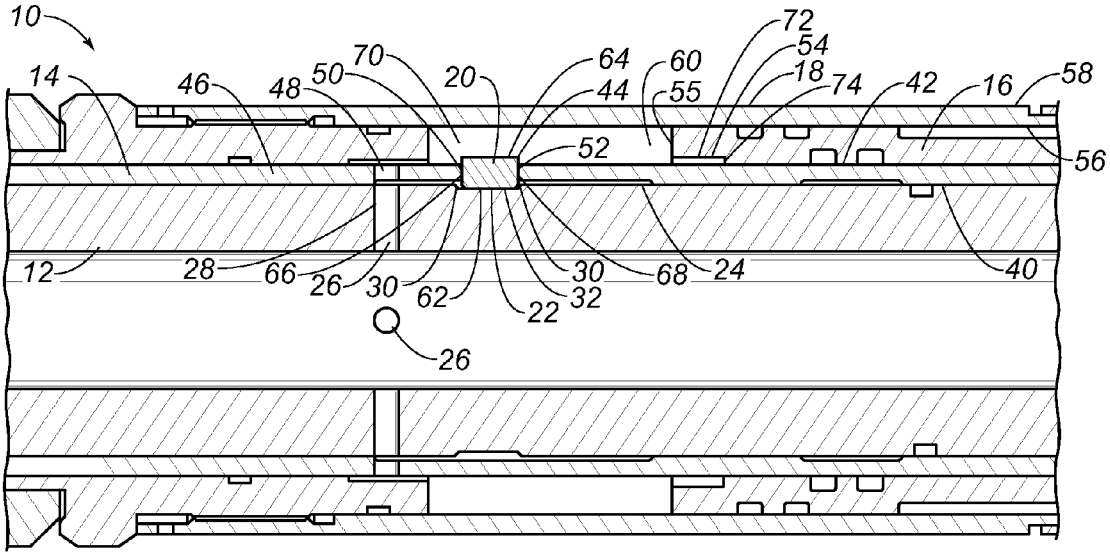
FIG. 3 is a sectional view of an embodiment of the system of the present invention, showing a transition from the first locked position to a second released position.
Figure 4:
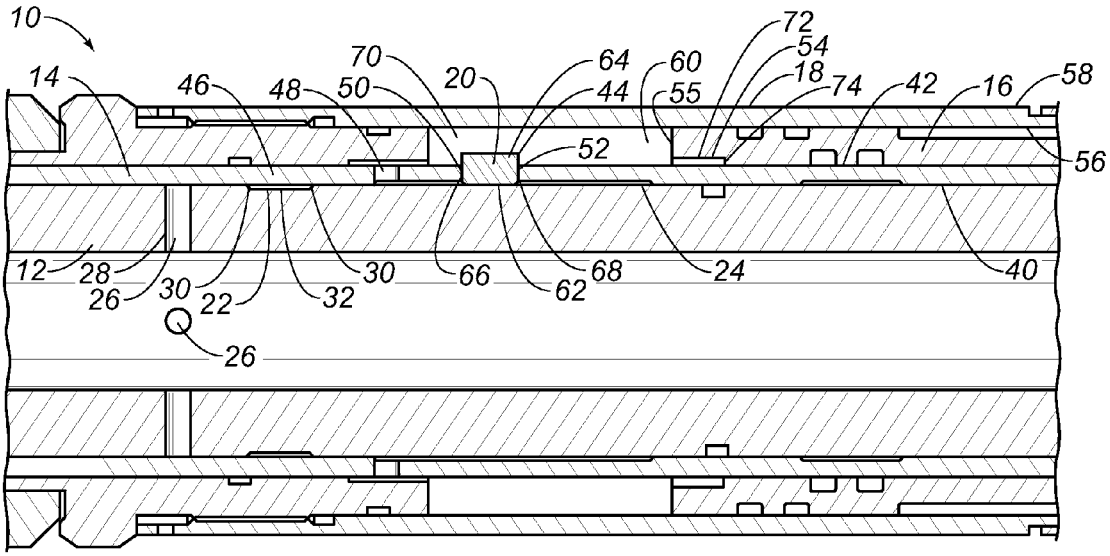
FIG. 4 is a sectional view of an embodiment of the system of the present invention, showing the second released position.

Referring to FIGS. 2-4, an embodiment of the present invention is the system 10 for setting a completion tool within a wellbore. There is a mandrel 12 of a liner system or string placed in an interior of the wellbore. The mandrel 12 has a generally tubular shape for extending down a casing and through the annulus. FIGS. 2-4 shows the mandrel 12 comprising an indentation 22 on an exterior 24 of the mandrel 12 and a pressure inlet 26 through a side wall 28 of the mandrel 12. The indentation 22 is comprised of sliding surfaces 30 at opposite ends of the indentation 22. The sliding surfaces 30 extend from a bottom 32 of the indentation 22 to the exterior 24. Embodiments of the indentation 22 include a concavity with slanted or angled walls, and a concavity with contoured walls. FIGS. 2-4 show a concavity with slanted walls. The indentation 22 is a concave inward of the mandrel 12. The sliding surfaces 30 are formed by the concavity. The angle of inclination of the sliding surfaces 30 is variable. The indentation 22 must be gradual with a horizontal and vertical dimension, whether the sliding surface is curved or linear. The embodiment of the pressure inlet 26 is a hole through the side wall 28. Other openings, besides a hole, may be a pressure inlet 26 in the present invention.

Embodiments of the system 10 include a completion tool with an inner sleeve 14, piston 16, and an outer sleeve 18. The completion tool can be any tool set by severing a mechanical link for placement. The inner sleeve 14, piston 16, and outer sleeve 18 may or may not be integral with active features of the completion tool, such as the inflatable element and perforated sleeve elements of a packer or the shear pins of a liner hanger. The system 10 includes these parts of the completion tool as the attachment to the mandrel 12 to show the protection of the setting of the completion tool by connecting to parts of the completion tool.

FIGS. 2-4 show embodiments of the inner sleeve 14 with a generally tubular shape. There is an interior surface 40 facing the mandrel 12 and an exterior surface 42 facing outward. The inner sleeve 14 comprises an aperture 44 through a side wall 46 of the inner sleeve 14 and a pressure conduit 48 through the side wall 46 of the inner sleeve 12. The aperture 44 is the means for engaging the mandrel 12 so that the inner sleeve 14 can interact with mandrel 12, piston 16, and outer sleeve 18 to protect the mechanical link or shear pins of the completion tool. FIGS. 2-4 show an embodiment of the aperture 44 with a first abutment surface 50 and a second abutment surface 52 on a side opposite the first abutment surface 50. The aperture 44 can be a groove aligned with the indentation 22 of the mandrel 12. FIGS. 2-4 show an embodiment of the pressure conduit 48 as an opening through the inner sleeve 14, such as a hole or channel, for alignment with the pressure inlet 26 of the mandrel 12.

The system 10 of the present invention includes embodiments of a piston 16 mounted on the inner sleeve 14 and facing the exterior surface 42 of the inner sleeve 14. There is a locking surface 54 at one end, which faces the exterior surface 42 of the inner sleeve 14. FIGS. 2-4 show various positions of the locking surface 54 relative to the aperture 44 and indentation 22. Alignment of the locking surface 54 affects the position of the system 10 in the first locked position or the second released position or between the two positions.

FIGS. 2-4 also show an embodiment of the outer sleeve 18. The outer sleeve 18 fits over the piston 16 and inner sleeve 14. The outer sleeve 18 also has a generally tubular shape. There is an interior side wall 56 facing the piston 16 and an exterior sidewall 58 facing outward. A gap 60 is formed by the interior side wall 56 of the outer sleeve 18 and exterior surface 42 of the inner sleeve 14. The piston 16 is housed in the gap 60 between the sleeves 14, 18 and can slide longitudinally along the interior side wall 56 of the outer sleeve 18 and the exterior surface 42 of the inner sleeve 14.

The dog means 20 is also shown in FIGS. 2-4. The dog means 20 can be structural member to mechanically engage the mandrel 12, inner sleeve 14, piston 16, and outer sleeve 18. The dog means 20 locks the completion tool relative to the mandrel 12 so that the movement of the completion tool matches the movement of the mandrel 12. The dog means 20 absorbs the stress of the mandrel 12 on the completion tool instead of the mechanical link or shear pins of the completion tool. In the embodiments of FIGS. 2-4, the dog means 20 has a mandrel interface 62, piston interface 64 on an end opposite the mandrel interface 62, a first face 66, and a second face 68 on a side opposite the first face 66. The dog means 20 removeably engages the mandrel 12, the inner sleeve 14, and the piston 16, depending upon the system 10 being in the first locked position or the second released position or between the two positions.

FIG. 2 shows the embodiment of the system 10 in the first locked position. The mandrel interface 62 abuts against the indentation 22 of the mandrel 12, the piston interface 64 abuts against the locking surface 54 of the piston 16. The dog means 20 is friction fit between the locking surface 54 of the piston 16 and the indentation 22 of the mandrel 12. The completion tool is held to the mandrel 12, and the dog means 20 engages the mandrel 12 stronger than any mechanical link or shear pin of the completion tool. In a first locked position, the locking surface 54 is aligned with the aperture 44 of the inner sleeve 14 and the indentation 22 of the mandrel 12.

FIG. 3 shows the embodiment of the system 10 in transition from the first locked position to the second released position. A pressure pulse through the mandrel passes through the pressure inlet 26 in fluid connection to the pressure conduit 48. The pressure conduit 48 is in fluid connection to the gap 60 between the sleeves 14, 18. The pulse actuates the piston 16 away from the dog means 20. The pressure inlet 26 is in fluid connection with the gap 60 through the pressure conduit 48. The alignment allows the transition from the first locked position to the second released position.

FIG. 4 shows the embodiment of the system 10 in the second released position. The outer sleeve 18 and the inner sleeve 14 and the one end of the piston 55 form a chamber 70 within the gap 60. The dog means 20 is now more housed within the chamber 70 because the mandrel interface 62 is released and separate from the indentation 22 and the piston interface 64 is released and separate from the locking surface 54 of the piston 16. FIG. 4 shows the indentation 22 moved away from the dog means 20. The completion tool is no longer held to the mandrel 12 by the dog means 20 so that the mandrel 12 can be used to apply force to sever the mechanical link or shear pin for setting the completion tool.

FIGS. 2-4 show one embodiment of the dog means 20. FIGS. 2-4 show the dog means 20 as a block member cooperative with the mandrel 12, the inner sleeve 14, and the piston 16. The mandrel interface 62 has a contact surface for engagement to the indentation 22 on the mandrel 12. The contact surface can be curved to account for the shape of the indentation 22 on the tubular mandrel 12. The first face 66 and the second face 68 are generally orthogonal to the mandrel interface 62, forming the cross-section of the block member as rectangular. The piston interface 64 also has a shape for engagement to the locking surface 54 on the piston 16. The piston 16 may be curved or tubular or some other cam element with a curvature compatible with the common axis of the mandrel 12, and sleeves 14, 18.

For the dog means 20 as a block member, the aperture 44 has a first abutment surface 50 and a second abutment surface 52 engaging the dog means 20. In the first locked position, a middle portion of the first face 66 is adjacent to the first abutment surface 50, and a middle portion of the second face 68 is adjacent the second abutment surface 52. The inner sleeve 14 can provide additional mechanical support beyond the strength of the indentation 22, dog member 20 and locking surface 54. In particular, a lower edge of the first face 66 and a lower edge of the second face 68 are adjacent sliding surfaces 30 of the indentation 22.

The embodiment of FIGS. 2-4 further show an embodiment of the piston 16 comprising a notch 72 on an end 55 of the piston 16. The notch 72 forming a recess connected to the chamber 70. The locking surface 54 and a side shoulder 74 comprise the notch 72. FIG. 2, in a first locked position, shows an upper edge of the second face 68 adjacent to the side shoulder 74 of the notch 72. The notch 72 allows the piston 16 to provide additional mechanical support beyond the strength of the indentation 22, dog member 20 and locking surface 54.

Figure 5:
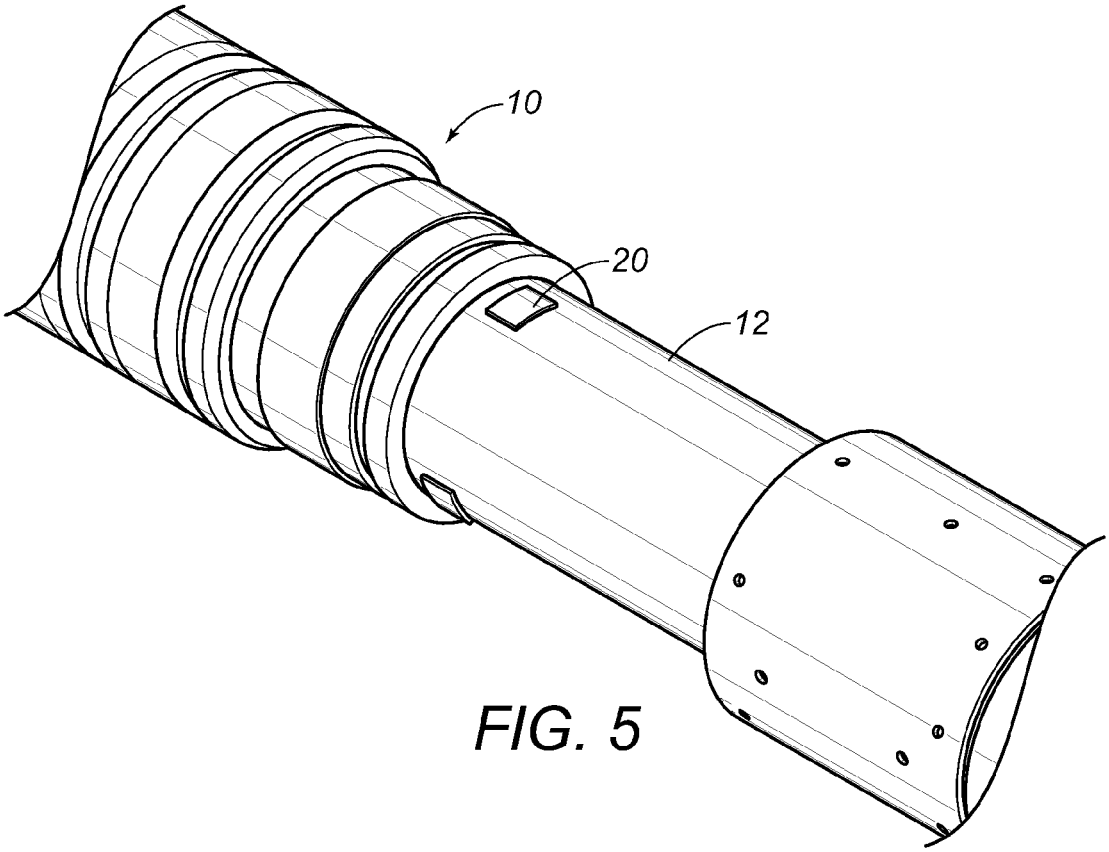
FIG. 5 is a partial perspective view of the embodiment of the system of FIGS. 1-3, showing the dog member in the mandrel.
Figure 6:
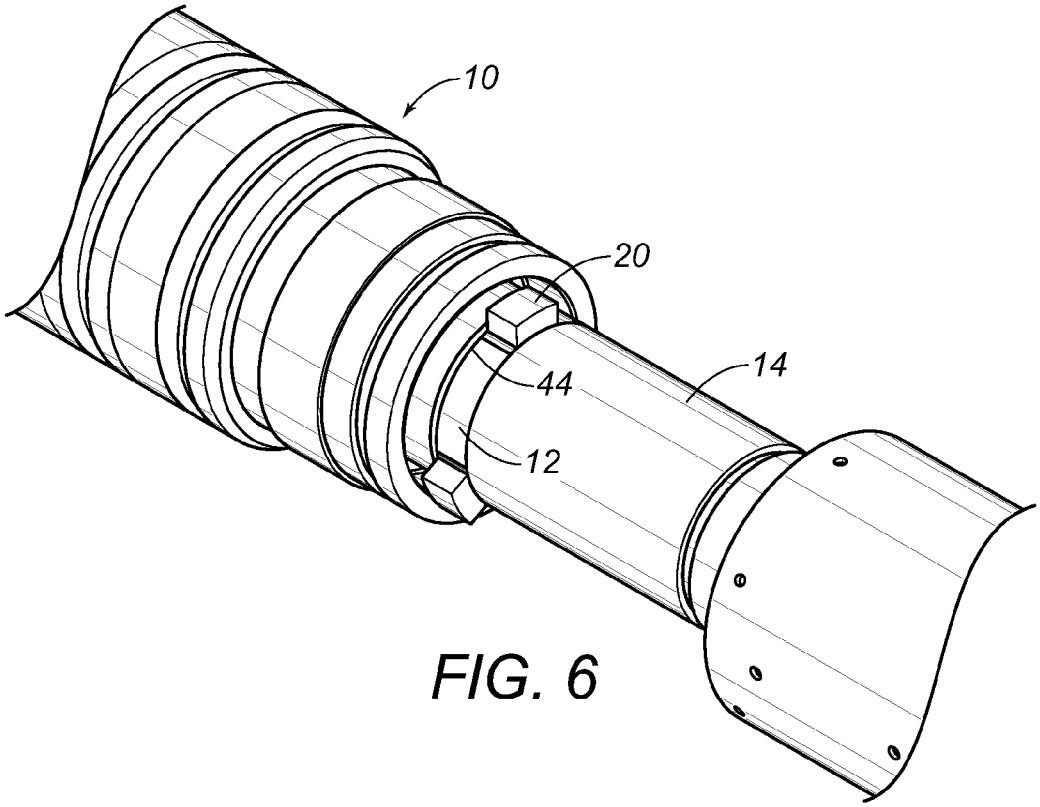
FIG. 6 is another partial perspective view of the embodiment of the system of FIG. 4, showing the inner sleeve with an aperture over the dog member in the mandrel.

FIGS. 5-6 show partial perspective views of the embodiment of FIGS. 2-4. FIG. 5 gives a view of the mandrel 12 with the dog means 20 in place. The block member embodiment is shown without the sleeves 14, 18 and the piston 16. The other structures are layers attributed to the completion tool or liner system. FIG. 6 provides the alternate view of the dog means 20 engaging the inner sleeve 14 with the aperture 44 as a groove. The additional strength of the inner sleeve 14 engaging the dog means 20 is shown in this embodiment.

Figure 7:
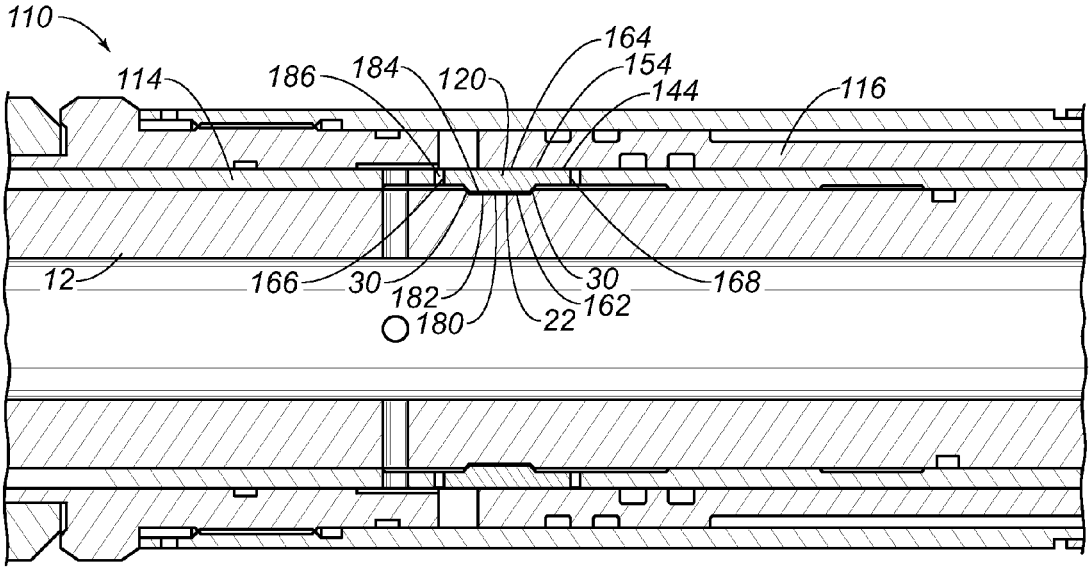
FIG. 7 is a sectional view of another embodiment of the system of the present invention, showing the dog member as a collet member in the first locked position.
Figure 8:
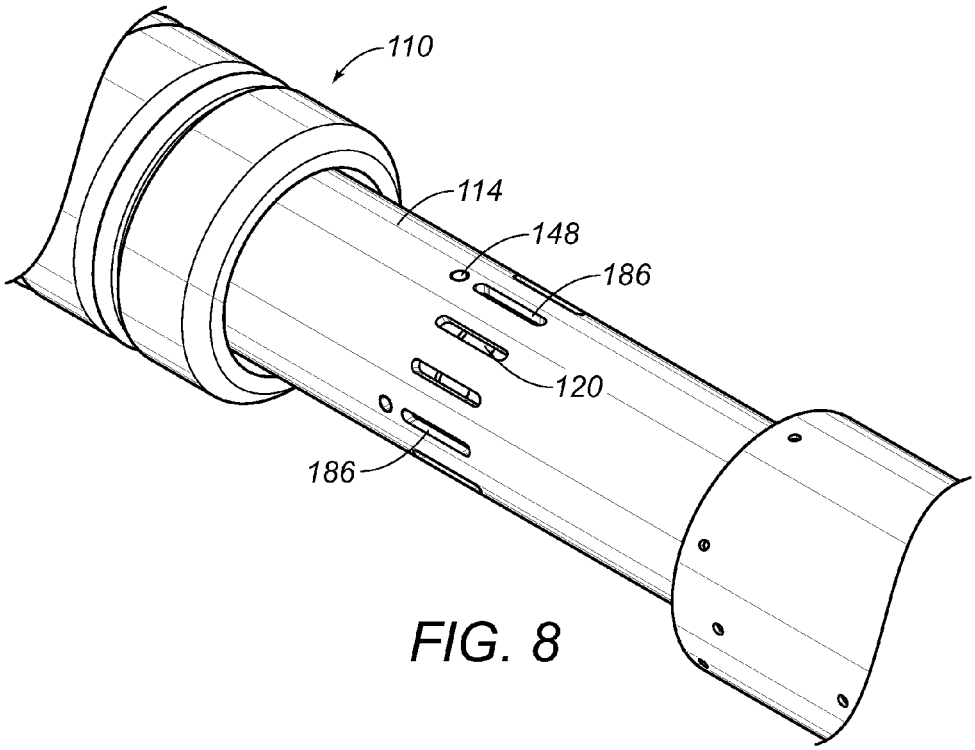
FIG. 8 is a partial perspective view of the embodiment of the system of FIG. 7, showing the inner sleeve with an aperture as a slot over the dog member in the mandrel.

Alternative embodiments of the system 110 are shown with an inner sleeve 114, a piston member 116 and a dog means 120 in FIGS. 7-8. The dog means 120 comprises a collet member cooperative with the mandrel 12, the inner sleeve 114, and piston 116. There is a mandrel interface 162 comprised of a protrusion 180. The protrusion 180 extends downward toward the mandrel 12 from the dog means 120 as a collet member. The contact area 182 for engagement to the indentation 22 on the mandrel 12 shows an alternative interaction in the first locked position. A lower portion 184 of the contact area 182 is adjacent the sliding surfaces 30 of the indentation 22. The protrusion 182 is friction fit in the indentation 22. The first face 166 and second face 168 of the dog means 120 as a collet member are isolated from the mandrel. The resilience of the dog means 120 is still greater than the mechanical link or shear pin of the completion tool, but a variation of the interrelationship of the sides of the dog means 120 are presented in this embodiment. The set of collet members around the mandrel 12 as the dog means 120 with contact area 182 can collectively provide sufficient strength greater than the mechanical link or shear pin of the completion tool. The inner sleeve 114 may not need to contribute resilience on the sides of the dog means 120 in this embodiment.

Additionally, the embodiment of FIGS. 7 and 8 show the piston 116 without a notch, so that the piston interface 164 engages the locking surface 154 on the piston 116. The flush engagement between the locking surface 154 and the dog means 120 must also result in a mechanical support of the mechanical link and shear pin of the completion tool. For the inner sleeve 114, the aperture 144 is comprised of a slot 186. The dog means 120 as the collet member extends through the slot 186 of the inner sleeve 114 so as to contact the piston 116. This embodiment of the inner sleeve 114 is consistent with the first face 166 and second face 168 of the dog means 120 as a collet member are isolated from the mandrel 12. FIG. 8 shows the partial perspective view with slots 186 and the dog means 120 as collet members around the mandrel 12. The pressure conduit 148 of the inner sleeve 114 is also visible in this view.

Figure 9:
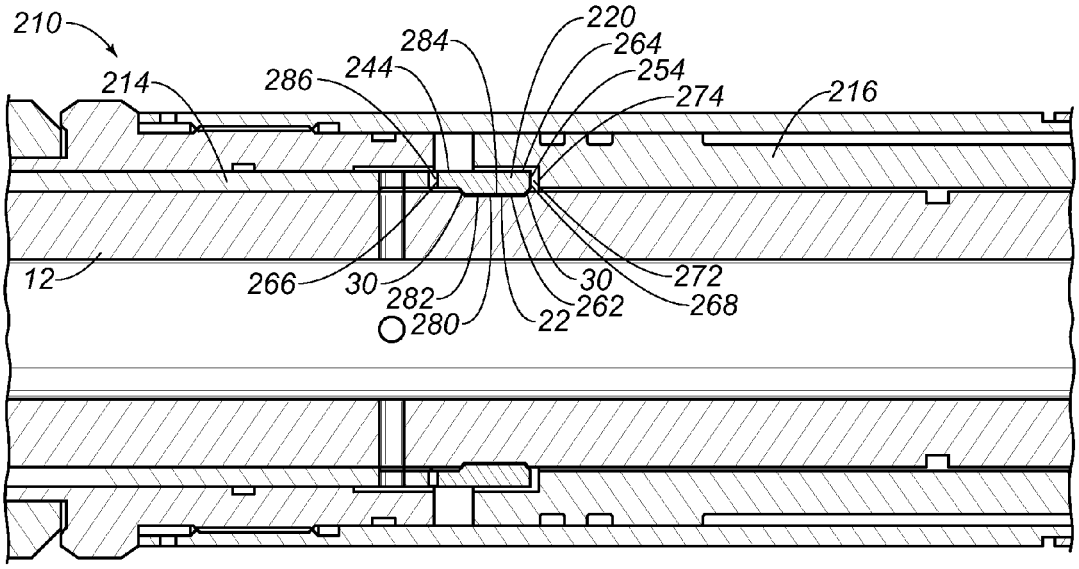
FIG. 9 is a sectional view of still another embodiment of the system of the present invention, showing the dog member as a collet member in the first locked position.
Figure 10:
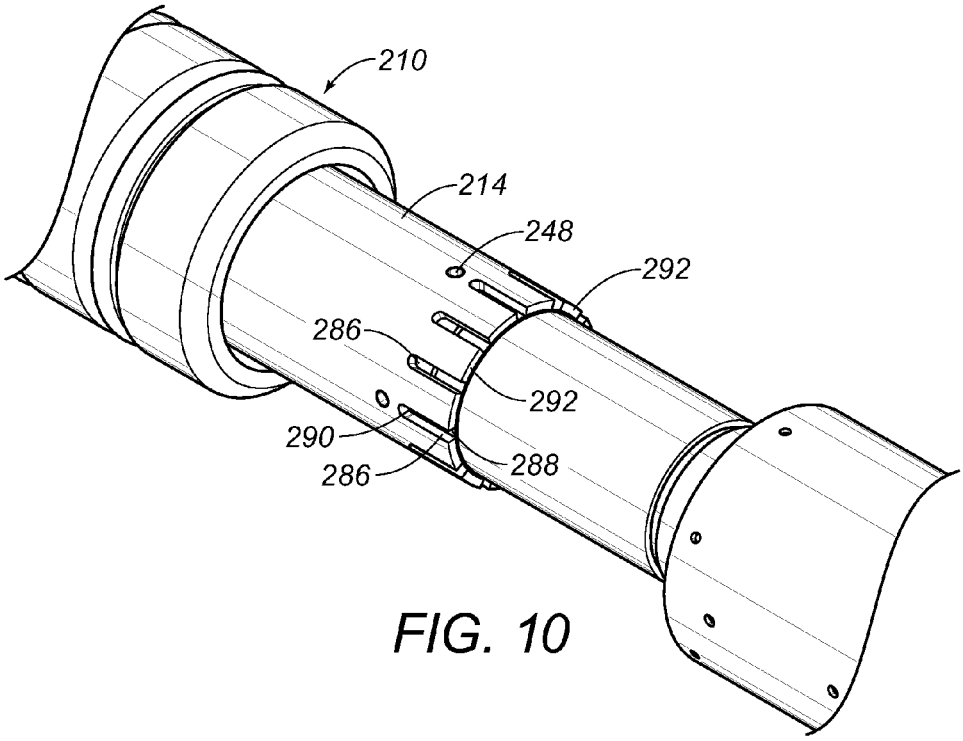
FIG. 10 is a partial perspective view of the embodiment of the system of FIG. 9, showing the inner sleeve with an aperture as a slit over the dog member in the mandrel and a notch in the piston.

Still another alternative embodiment of the system 210 is shown with an inner sleeve 214, a piston member 216 and a dog means 220 in FIGS. 9-10. The dog means 220 comprises another type of collet member cooperative with the mandrel 12, the inner sleeve 214, and piston 216. There is a mandrel interface 262 comprised of a protrusion 280. The protrusion 280 extends downward toward the mandrel 12 from the dog means 220 as another collet member. The contact area 282 for engagement to the indentation 22 on the mandrel 12 shows still another alternative interaction in the first locked position. A lower portion 284 of the contact area 282 is adjacent the sliding surfaces 30 of the indentation 22. The protrusion 282 is friction fit in the indentation 22. The first face 266 of the dog means 220 as another collet member remains isolated from the mandrel 12. The second face 268 become flush with edge of the indentation 22 facing the piston 216. The second face 268 is not isolated from the mandrel 12 by engaging the piston 216. At least one side, the second face 268, contributes to the mechanical strength of the dog means 220 against the mandrel 12.

The resilience of the dog means 220 remains greater than the mechanical link or shear pin of the completion tool, using another variation of the interrelationship of the sides of the dog means 220 presented in this embodiment of FIGS. 9 and 10. The set of collet members around the mandrel 12 as the dog means 220 with contact area 282 and second face 268 can collectively provide sufficient strength greater than the mechanical link or shear pin of the completion tool. The inner sleeve 214 may not need to contribute resilience on the sides of the dog means 220 in this embodiment.

Furthermore, the alternative embodiment of FIGS. 9 and 10 show the piston 216 with a notch 272, so that the piston interface 264 engages the locking surface 254 on the piston 216 and the side shoulder 274 engages the second face 268 of the dog means 220. The engagement between the locking surface 254 and side shoulder 274 to the dog means 220 must also result in a mechanical support of the mechanical link and shear pin of the completion tool. For the inner sleeve 214, the aperture 244 is comprised of a slit 286. The dog means 220 as the another collet member extends through the slot 286 of the inner sleeve 214 so as to contact the piston 216. This embodiment of the inner sleeve 214 further includes a terminal edge 292 of the inner sleeve 214. There is an opened end 288 and a closed end 290 of the slit 286, which remains consistent with the first face 266 of the dog means 220 being isolated from the mandrel 12. The opened end 288 and terminal edge 292 of the inner sleeve do not engage the second face 268 of the dog means 220. FIG. 10 shows the partial perspective view with slits 286 and the dog means 220 as other collet members around the mandrel 12. The pressure conduit 248 of the inner sleeve 214 is similarly visible in this view. The embodiment of the FIGS. 9 and 10 show collective contribution of mechanical support by the dog means 220 on the piston 216, such that the inner sleeve 214 does not need to engage both sides of the dog means 220.

The present invention also includes the method for setting a completion tool within a wellbore, according to embodiments of the system in FIGS. 2-10. The method includes assembling the dog member in a first locked position for run in of the completion tool, as in FIGS. 2, 7, and 9. The mandrel interface of the dog member abuts against the indentation of the mandrel, while piston interface of the dog member abuts against the locking surface of the piston. The dog member is friction fit between the mandrel and the piston. Mechanical force of the mandrel on the completion tool is resisted by the dog member in the concavity and any mechanical link or shear pin.

When the completion tool is positioned in a desired location in the wellbore, a pressure pulse is sent through the pressure inlet of the mandrel, through the pressure conduit in the inner sleeve, and into the gap between the inner sleeve and the outer sleeve. The gap forms the chamber by expanding so that the piston is moved relative to the dog member. In this transition from the first locked position, as in FIG. 3, the piston interface releases from the locking surface of the piston. The dog member can move further into the chamber without obstruction of the piston. Moving the mandrel in this transition will drive the dog member along a sliding surface of the indentation so as to release the mandrel interface from the indentation of the mandrel. Now, as in FIG. 4, the dog member is housed in the chamber in a second released position, corresponding with movement of the mandrel to set the completion tool. The mechanical link or shear pins of the completion tool can be severed as planned without the dog member supporting the completion tool on the mandrel.

Embodiments of the method include directional movement of the dog member toward the first face or the second face. The dog member can be released from the indentation from either side by movement of the mandrel in either direction.

When the dog member is a block member, as in FIG. 2, the aperture has a first abutment surface and a second abutment surface. Assembling the dog means in the first locked position comprises positioning a middle portion of the first face adjacent the first abutment surface and a middle portion of the second face adjacent the second abutment surface. For the embodiment with a notch on the end of the piston, assembling the dog means in the first locked position comprises setting an upper edge of the second face adjacent to the side shoulder of the notch.

When the dog member is a collet member, as in FIG. 7, assembling the dog means in the first locked position comprises extending the collet member through the aperture. FIG. 7 shows the aperture as a slot. When the dog member is another type of collet member, as in FIG. 9, assembling the dog means in the first locked position comprises extending the collet member through the aperture with the aperture being a slit.

Any completion tool set by a mechanical link, such as shear pins, is compatible with the embodiments of the system of the present invention. The shear pin or other mechanical link is severed when the completion tool reaches the desired location within the wellbore. Mechanical severing and setting slip devices and expanding packer elements are performed by the completion tool. Packers, liner hangers, and anchors are known completion tools. Additionally, a compatible completion tool will have an inner sleeve, piston, and outer sleeve.

The system incorporates structures of a completion tool for engaging the mandrel but remains separate and independent from the completing work of the completion tool. The packer must still isolate a zone with the appropriate parts, separate from the system of the present invention. The system of the present invention prevents the shear pins from severing during a run-in process. When run in, the system is in a first locked position so that movement of the mandrel back and forth stresses the dog means more than the mechanical link or shear pins. The shear pins are not severed accidentally, at the wrong time and wrong place within the wellbore.

Additionally, the system of the present invention protects wear on the shear pins or other mechanical link during the run in through the wellbore. The dog member engages the mandrel and the completion tool at the piston. In some embodiments, the dog member also engages the inner sleeve of the completion tool. Various combinations of engaging or not engaging the inner sleeve are covered by embodiments of the system of the present invention. The dog member provides mechanical strength so that the mechanical link or shear pins do not bear the brunt of stress from the mandrel. There is less stress so that exposure to possible damage and wear is reduced. In some embodiments, the risk is shared by the dog member in the first locked position. Generally, the dogs withstand greater force than the shear pins or other mechanical link, so the dogs must be released for the shear pins to engage the force for severing. The connection of the dog to the mandrel can be stronger than the mechanical link or shear pins. Alternatively, there must be at least some added resistance to severing by the dogs, even if less strong than a shear pin. Collectively, multiple dogs, such as a ring of collet members, can provide the additional support of the mechanical link or shear pin.

When ready to be set, there is a pressure pulse to control of the setting of the completion tool. The intentional pressure pulse actuates the piston so that the dog means can release from the mandrel. Now, the mechanical link is directly exposed to the stress of the mandrel so that the mechanical link can be broken at the desired location. The dog means is locked until the completion tool is ready. The dogs are locked during run-in and released for setting. The pressure pulse is the additional control for the more consistent and reliable setting of the completion tool by the shear pins or other mechanical link. There is setting of the completion tool only when the completion tool is intended to be set.

The foregoing disclosure and description of the invention is illustrative and explanatory thereof. Various changes in the details of the illustrated structures, construction and method can be made without departing from the true spirit of the invention.

We claim:

1. A system for setting a completion tool within a wellbore comprising:

a mandrel being placed in an interior of the wellbore and having a generally tubular shape, said mandrel being comprised of an indentation on an exterior and a pressure inlet through a side wall of said mandrel, wherein said indentation is comprised of sliding surfaces at both ends of said indentation, said sliding surfaces extending from a bottom of said indentation to said exterior;

an inner sleeve of the completion tool, having a generally tubular shape and an interior surface facing said mandrel and an exterior surface facing outward, wherein said inner sleeve is comprised of an aperture through a side wall of said inner sleeve and a pressure conduit through said side wall of said inner sleeve;

a piston of the completion tool, being mounted on said inner sleeve and facing said exterior surface of said inner sleeve, said piston being comprised of a locking surface at one end, said locking surface facing said exterior surface of said inner sleeve;

an outer sleeve of the completion tool, having a generally tubular shape, an interior side wall facing said piston and an exterior sidewall facing outward, said interior side wall forming a gap between said outer sleeve and said inner sleeve, said piston being housed within said gap and being slideable longitudinally along said interior side wall of the outer sleeve and said exterior surface of said inner sleeve; and a dog means having a mandrel interface, piston interface on an end opposite said mandrel interface, a first face, and a second face on a side opposite said first face, said dog means being removeably engaged to said mandrel, said inner sleeve, and said piston, wherein, in a first position, said mandrel interface abuts against said indentation of said mandrel, said piston interface abutting said locking surface of said piston, said dog means being friction fit between said locking surface of said piston and said indentation of said mandrel, and wherein, in a second position, said outer sleeve and said inner sleeve and said one end of said piston form a chamber within said gap, said dog means being housed within said chamber, said mandrel interface being released and separate from said indentation, said piston interface being released and separate from said locking surface of said piston.

2. The system for setting a completion tool, according to claim 1, wherein said indentation is selected from a group consisting of a concavity with slanted walls, and a concavity with contoured walls, said sliding surfaces being formed by said indentation.

3. The system for setting a completion tool, according to claim 1, in said first position, said locking surface being aligned with said aperture of said inner sleeve and said indentation of said mandrel.

4. The system for setting a completion tool, according to claim 1, wherein said pressure inlet is in fluid connection with said gap, said pressure conduit of said inner sleeve being aligned with said pressure inlet of said mandrel, said pressure conduit being connected to said gap so as to transition from said first position to said second position.

5. The system for setting a completion tool, according to claim 1, wherein said dog means comprises a block member cooperative with said mandrel, said inner sleeve, and said piston, said mandrel interface having a contact surface for engagement to said indentation on said mandrel, said first face and said second face being generally orthogonal to said mandrel interface, and said piston interface having a shape for engagement to said locking surface on said piston, and wherein said aperture has a first abutment surface and a second abutment surface on a side opposite said first abutment surface.

6. The system for setting a completion tool, according to claim 5, wherein, in said first position, a middle portion of said first face is adjacent to said first abutment surface and a middle portion of said second face being adjacent said second abutment surface.

7. The system for setting a completion tool, according to claim 5, wherein, in said first position, a lower edge of said first face and a lower edge of said second face are adjacent sliding surfaces of said indentation.

8. The system for setting a completion tool, according to claim 5, wherein said piston further comprises a notch on an end of the piston, said notch forming a recess connected to said chamber, said notch being comprised of said locking surface and a side shoulder, and wherein, in said first position, an upper edge of said second face is adjacent to said side shoulder of said notch.

9. The system for setting a completion tool, according to claim 1, wherein said dog means comprises a collet member cooperative with the mandrel, said inner sleeve, and piston, said mandrel interface being comprised of a protrusion having a contact area for engagement to said indentation on said mandrel, and said piston interface having a shape for engagement to said locking surface on said piston, and wherein said aperture is comprised of a slot, said collet member extending through said slot of said inner sleeve so as to contact said piston.

10. The system for setting a completion tool, according to claim 9, wherein, in said first position, said protrusion of the mandrel interface is friction fit in the indentation, a lower portion of said contact area being adjacent sliding surfaces of said indentation.

11. The system for setting a completion tool, according to claim 1, wherein said dog means comprises a collet member cooperative with the mandrel, said inner sleeve, and piston, said mandrel interface being comprised of a protrusion having a contact area for engagement to said indentation on said mandrel, and said piston interface having a shape for engagement to said locking surface on said piston, and wherein said aperture is comprised of a slit having a closed end and an opened end, said collet member extending through said slit of said inner sleeve so as to contact said piston.

12. The system for setting a completion tool, according to claim 11, wherein, in said first position, said protrusion of the mandrel interface is friction fit in the indentation, a lower portion of said contact area being adjacent sliding surfaces of said indentation.

13. The system for setting a completion tool, according to claim 11, wherein said piston further comprises a notch on an end of the piston, said notch forming a recess connected to said chamber, said notch being comprised of said locking surface and a side shoulder, and wherein, in said first position, an upper edge of said second face is adjacent to said side shoulder of said notch.

14. The system for setting a completion tool, according to claim 13, wherein, in said first position, said piston is at least partially housed within said gap between said opened end of said slit and tip of said inner sleeve and said outer sleeve.

15. A method for installing within a wellbore, the method comprising the steps of:

assembling a completion tool according to claim 1, the dog means in said first position for run in of the completion tool, said mandrel interface abutting said indentation of said mandrel, piston interface abutting said locking surface of said piston, said dog means being friction fit between said mandrel and said piston;

positioning the completion tool in a desired location in the wellbore;

sending a pressure pulse through said pressure inlet of said mandrel, through said pressure conduit in said inner sleeve, and into said gap between said inner sleeve and said outer sleeve;

actuating said piston to move relative to the dog means so as to form said chamber, said piston interface being released from said locking surface of said piston;

driving said dog means along a sliding surface of said indentation by moving said mandrel along common axis with said inner sleeve and said outer sleeve;

releasing said mandrel interface from said indentation of said mandrel; and housing said dog means in said chamber in said second position for setting the completion tool.

16. The method for setting a completion tool, according to claim 15, wherein the step of driving said dog means is comprised of directional movement of said dog means toward one direction of a group consisting of a direction toward said first face and a direction toward said second face.

17. The method for setting a completion tool, according to claim 15, wherein the dog means is a block member, wherein said aperture has a first abutment surface and a second abutment surface on a side opposite said first abutment surface, and wherein said step of assembling the dog means in said first position comprises positioning a middle portion of the first face adjacent said first abutment surface and a middle portion of the second face adjacent said second abutment surface.

18. The method for setting a completion tool, according to claim 17, wherein said piston further comprises a notch on an end of the piston, said notch forming a recess connected to said chamber, said notch being comprised of said locking surface and a side shoulder, and wherein said step of assembling the dog means in said first position comprises setting an upper edge of the second face adjacent to said side shoulder of said notch.

19. The method for setting a completion tool, according to claim 15, wherein the dog means is a collet member, wherein said aperture is a slot in said inner sleeve, and wherein said step of assembling the dog means in said first position comprises extending said collet member through said slot.

20. The method for setting a completion tool, according to claim 15, wherein the dog means is a collet member, wherein said aperture is a slit in said inner sleeve, and wherein said step of assembling the dog means in said first position comprises extending said collet member through said slit.

* * * * *